US011384608B2

(12) United States Patent
Haggart

(10) Patent No.: US 11,384,608 B2
(45) Date of Patent: Jul. 12, 2022

(54) TUBULAR LIFT RING

(71) Applicant: ProTorque Connection Technologies, Ltd., Edmonton (CA)

(72) Inventor: Steven Haggart, Spruceview (CA)

(73) Assignee: ProTorque Connection Technologies, Ltd., Edmonton (CA)

( * ) Notice: Subject to any disclaimer, the term of this patent is extended or adjusted under 35 U.S.C. 154(b) by 0 days.

(21) Appl. No.: 17/407,391

(22) Filed: Aug. 20, 2021

(65) Prior Publication Data

US 2021/0381325 A1 Dec. 9, 2021

Related U.S. Application Data

(63) Continuation of application No. 16/427,275, filed on May 30, 2019, now Pat. No. 11,125,028.

(60) Provisional application No. 62/678,294, filed on May 31, 2018.

(51) Int. Cl.
*E21B 19/07* (2006.01)

(52) U.S. Cl.
CPC ..... *E21B 19/07* (2013.01)

(58) Field of Classification Search
CPC ..... E21B 19/07
See application file for complete search history.

(56) References Cited

U.S. PATENT DOCUMENTS 1,450,845 A * 4/1923 Flournoy, Jr. ..... E21B 12/00 285/45
1,499,225 A * 6/1924 Krell ..... E21B 19/07 294/102.2
1,520,374 A * 12/1924 Thompson ..... E21B 19/06 166/85.1
1,600,860 A * 9/1926 Young ..... F16L 57/005 138/96 T
1,690,434 A * 11/1928 Rockelman ..... B08B 9/045 15/104.095
1,692,710 A * 11/1928 Spahn ..... H02G 3/06 220/288
1,967,702 A * 7/1934 Brady ..... F21V 17/00 362/350
2,027,734 A * 1/1936 Johnson ..... E21B 19/06 285/29
2,073,389 A * 3/1937 Engstrom ..... F16L 57/005 138/96 T
2,156,237 A * 4/1939 Draper ..... B65D 39/082 220/288
2,165,860 A * 7/1939 Killmeyer ..... F16N 3/06 222/215
2,261,035 A * 10/1941 Miller ..... F16K 17/16 220/89.2
2,337,456 A * 12/1943 Draper ..... B65D 39/082 220/259.4
2,657,955 A * 11/1953 Manning ..... B05B 1/3086 239/458
2,670,132 A * 2/1954 Podbielniak ..... B04B 5/06 494/22

(Continued)

*Primary Examiner* — Aaron L Lembo

(57) ABSTRACT

A tubular lift ring for positioning a tubular for making up a string. The ring includes internal threads that match a portion of the external threads on the end of the tubular. The ring further includes an upset that contacts the setting plate of an elevator for clamping about the tubular and lifting it into place above the borehole.

6 Claims, 4 Drawing Sheets

(56) References Cited

U.S. PATENT DOCUMENTS 2,719,025 A * 9/1955 Stone ..... E21B 19/12 173/167
3,038,502 A * 6/1962 Hauk ..... E21B 17/006 138/96 R
3,067,593 A * 12/1962 McCool ..... E21B 17/1085 464/183
3,111,145 A * 11/1963 Kerns ..... A61M 1/0011 141/26
3,240,232 A * 3/1966 Matherne ..... B65D 59/00 138/96 T
3,262,730 A * 7/1966 Widmer ..... F16H 21/08 294/86.25
3,295,913 A * 1/1967 Walther ..... G02B 13/04 359/665
3,420,585 A * 1/1969 Hans ..... B61F 15/26 384/189
3,485,271 A * 12/1969 Halsey ..... B65D 59/00 138/96 T
3,858,613 A * 1/1975 Musslewhite ..... E21B 17/006 138/96 T
3,930,710 A * 1/1976 Sollanek ..... H01R 13/516 439/472
4,114,698 A * 9/1978 Webb ..... E21D 3/00 173/1
4,173,988 A * 11/1979 Fowler ..... F16L 57/005 138/96 T
4,349,048 A * 9/1982 Clark ..... E21B 19/155 138/96 R
4,415,005 A * 11/1983 Janzen ..... E21B 17/006 138/89
4,492,666 A * 1/1985 Dreyfuss ..... B29C 70/766 264/261
4,506,730 A * 3/1985 McCollin ..... E21B 17/12 166/85.1
4,582,090 A * 4/1986 Chase ..... B65D 59/06 138/89
4,583,592 A * 4/1986 Gazda ..... E21B 23/006 166/116
4,593,773 A * 6/1986 Skeie ..... E21B 21/02 175/85
4,798,404 A * 1/1989 Iyanicki ..... F16L 19/075 285/12
5,083,356 A * 1/1992 Gonzalez ..... E21B 19/00 29/429
5,148,835 A * 9/1992 Clark ..... B65D 59/06 138/96 R
5,303,743 A * 4/1994 Vincent ..... B65D 59/06 138/96 T
5,352,383 A * 10/1994 Johnson ..... C10M 129/50 252/389.62
5,611,398 A * 3/1997 Duhn ..... E21B 33/03 166/379
5,782,303 A * 7/1998 Christian ..... E21B 43/127 166/154
6,082,793 A * 7/2000 Gagnon ..... B66C 1/34 29/237
6,196,270 B1 * 3/2001 Richards ..... B65D 59/02 138/96 R
6,854,520 B1 * 2/2005 Robichaux ..... E21B 19/07 166/380
7,040,410 B2 * 5/2006 McGuire ..... E21B 33/04 166/379
7,159,619 B2 * 1/2007 Latiolais, Jr. ..... B65D 59/00 138/96 T
7,281,546 B2 * 10/2007 Goodson ..... F16L 57/005 138/89
7,357,434 B2 * 4/2008 Latiolais, Jr. ..... E21B 19/10 294/119.2
7,370,707 B2 * 5/2008 McDaniel ..... E21B 19/004 166/380
7,404,419 B2 * 7/2008 Pajaro Gonzalez .. F16L 57/005 138/89
8,001,995 B2 * 8/2011 Molloy ..... F01M 11/0408 138/89
8,375,995 B2 * 2/2013 Courtois ..... F16L 57/005 138/96 T
8,424,570 B2 * 4/2013 Baker ..... F16L 15/002 138/96 T
8,794,684 B2 * 8/2014 Angelle ..... E21B 19/07 294/102.2
9,115,547 B2 * 8/2015 Angelle ..... B66C 1/12
9,359,838 B2 * 6/2016 Bull ..... E21B 17/00
9,404,321 B2 * 8/2016 Williams ..... B66C 1/66
9,518,431 B2 * 12/2016 Webre ..... E21B 19/07
9,732,591 B2 * 8/2017 Mouton ..... E21B 17/07
9,784,041 B2 * 10/2017 Kinert ..... E21B 19/06
9,784,053 B2 * 10/2017 Magnuson ..... E21B 19/10
9,920,412 B2 * 3/2018 Scott ..... C22C 38/48
10,344,540 B2 * 7/2019 Nijjar ..... E21B 17/042
10,415,340 B2 * 9/2019 Cavalheiro ..... E21B 33/14
2004/0201131 A1 * 10/2004 Goodson ..... F16L 57/005 264/220
2005/0081933 A1 * 4/2005 Latiolais et al. ..... F16L 57/005 138/96 T
2010/0200221 A1 * 8/2010 Sipos ..... E21B 19/07 166/250.01
2011/0232895 A1 * 9/2011 Klotz ..... E21B 17/042 166/77.51
2015/0184787 A1 * 7/2015 Rubin ..... F16L 57/005 138/96 T
2015/0233504 A1 * 8/2015 Smith ..... F16L 57/005 285/27
2017/0089151 A1 * 3/2017 Cavalheiro ..... E21B 19/04
2019/0368281 A1 * 12/2019 Haggart ..... E21B 19/02
2021/0002966 A1 * 1/2021 Church ..... E21B 17/10

* cited by examiner

TUBULAR LIFT RING

CROSS-REFERENCE TO RELATED APPLICATION

This application claims the benefit of U.S. Provisional Patent Application No. 62/678,294 filed May 31, 2018 and U.S. Non-Provisional patent application Ser. No. 16/427,275 filed May 30, 2019, which is hereby incorporated by reference in its entirety herein.

BACKGROUND OF THE INVENTION

I. Field of the Invention

The present disclosure relates generally to tools for rig drilling equipment in the field of oil and gas wells, and more specifically to an apparatus for safely transporting oilfield tubulars, and more particularly to an apparatus to raise and/or lower a length of oilfield tubulars and/or for otherwise safely moving a length of oilfield tubulars.

II. Description of the Prior Art

Conventional drilling operations for hydrocarbon exploration, exploitation and production utilize many lengths of individual tubulars which are made up into a string, where the tubulars are connected to one another by means of screw threaded couplings provided at each end. Various operations require strings of different tubulars, such as drill pipe, casing and production tubing.

The individual tubular sections are made up into the required string which is inserted into the ground by a make up/break out unit, where the next tubular to be included in the string is lifted into place just above the make up/break out unit. A first conventional method of doing this uses a single joint elevator system which attaches or clamps onto the outside surface of one tubular section and which then lifts upwards. A second conventional method for doing this utilizes a lift nubbin which comprises a screw thread which engages with the box end of the tubular such as a drill pipe, and the lift nubbin and tubular are lifted upwards by a cable. However, this second method in particular can be relatively dangerous since the lift nubbin and tubular will tend to sway uncontrollably as they are being pulled upwards by the cable.

Once lifted into place, conventional drilling rigs utilize a make up/break out system to couple/decouple the tubular pipe sections from the tubular string. A conventional make up/break out system comprises a lower set of tongs, which are brought together to grip the lower pipe like a vice, and an upper set of tongs which firstly grip and then secondly rotate the upper pipe relative to the lower pipe and hence screw the two pipes together. In addition to this conventional make up/break out system, a conventional drilling rig utilizes a rotary unit to provide rotation to the drill string to facilitate drilling of the borehole, where the conventional rotary unit is either a rotary table provided on the drill rig floor or a top drive unit which is located within the drilling rig derrick.

In order to position a tubular and hoist it into place, elevators are generally employed (using a threaded collar as a contact point for the lift), enabling the tubular to be lifted into place, connected to a string of tubulars, and run into a wellbore. Again, one type of elevator is a slip type elevator, sometimes referred to as a "MYC/HYC" elevator. The slip-type elevator includes slips, which may have teeth or be non-marking, that engage the outer diameter of the tubular. Typically, the slips are pushed radially inward into engagement with the outer diameter of the tubular. The radial force is provided by an axial engagement between a setting plate and an upset or shoulder, generally at the end of the shoulder. Using a tapered interface, the axial engagement of the setting plate with the upset in translated into a radially-inward force on the slips, causing the slips to engage the tubular. As noted, another type of elevator utilizes a cable that connects to a lift nubbin which comprises a screw thread which engages with the box end of the tubular, and the lift nubbin and tubular are lifted upwards by the cable.

More particularly, in order to transfer a tubular from a horizontal position (i.e., as stored) to a vertical position (for being made-up and run in) using the so-called lift nubbin, a threaded insert or lift nubbin, is threaded into the swaged box. The lift nubbin has a larger diameter at the top, which serves as the upset for the elevator. While providing adequate tubular placement, this design typically requires the use of a special bored side door to correctly interface with the tubular of the lift nubbin, due to the larger outer diameter of the swaged box. Additionally, slip-type elevators are generally not acceptable for use with the swaged box tubulars, because the taper of the swaged box may cause the slips of the elevator to engage the tapered region of the swaged box, resulting in an incomplete engagement of the outer diameter of the tubular. This, in turn, can result in increased local stress in the areas where the slips engage.

Furthermore, due to the proprietary tubular threads, the prior art so-called nubbins are typically manufactured and provided by the tubular manufacturer. As such, the manufacturer essentially has a monopoly on same and can assign whatever cost basis it desires.

The present disclosure overcomes the disadvantages of presently available tubular lift mechanisms. Accordingly, it is a general object of this disclosure to provide an improved tubular lift device.

It is another general object of the present disclosure to provide a tubular lift ring.

It is a more specific object of the present disclosure to provide a tubular lift ring that can be utilized by any type of tubular, regardless of the manufacturer.

It is still another more specific object of the present disclosure to provide a lockable tubular lift ring.

These and other objects, features and advantages of this disclosure will be clearly understood through a consideration of the following detailed description.

SUMMARY OF THE INVENTION

According to an embodiment of the present disclosure, there is provided a tubular lift ring having an outside and an inside diameter which define an upset for a cooperating elevator. The ring includes internal threads for threading over an end portion of a ring thread machined tubular.

According to an embodiment of the present disclosure there is also provided a tubular positioning combination having a tubular member with external threads on one end and a portion thereof including lift ring threading. A tubular lift ring having an outside and an inside diameter which define an upset for a cooperating elevator. The ring includes internal threads for threading over the end portion of the ring thread machined tubular.

According to an embodiment of the present disclosure there is also provided a method for positioning a tubular for making up a tubular connection including machining a ring threads over a portion of the external threads of a tubular, threading a lift ring having internal threads and an upset, on the portion of the tubular, securing the lift ring in place, engaging the tubular with an elevator having a setting plate that contacts the upset of the ring and then clamps about the tubular, and lifting the tubular into place.

BRIEF DESCRIPTION OF THE DRAWINGS

The present disclosure will be more fully understood by reference to the following detailed description of one or more preferred embodiments when read in conjunction with the accompanying drawings, in which like reference characters refer to like parts throughout the views and in which.

DESCRIPTION OF THE PREFERRED EMBODIMENTS

One or more embodiments of the subject disclosure will now be described with the aid of numerous drawings. Unless otherwise indicated, use of specific terms will be understood to include multiple versions and forms thereof.

The tubular lift ring of the present disclosure can be utilized in many tubular applications in the oil and gas industry. While an integral joint tubing string and a collared joint connected string will be discussed herein, it will be appreciated that other types of make up and break out applications can be improved upon with this ring. With respect to an integrated joint tubing, there are typically external threads at one end and internal threads at the other. Accordingly, this type of oil pipe string can be connected without the use of tubular couplings. Cylindrical surface, conical surface, spherical surface and reverse circular cone step surfaces may be arranged successively on the outer end of the external thread and inner end of the internal thread parts. These metal surfaces form a sealing structure at the first step. On the other side of the external and the internal joints there is a second step which forms the major anti-torque step. The second step and the first step form a double-step structure. On the other hand, and with respect to a collar connected string, successive tubular external pin threads are coupled to a collar therebetween.

Figure 1:
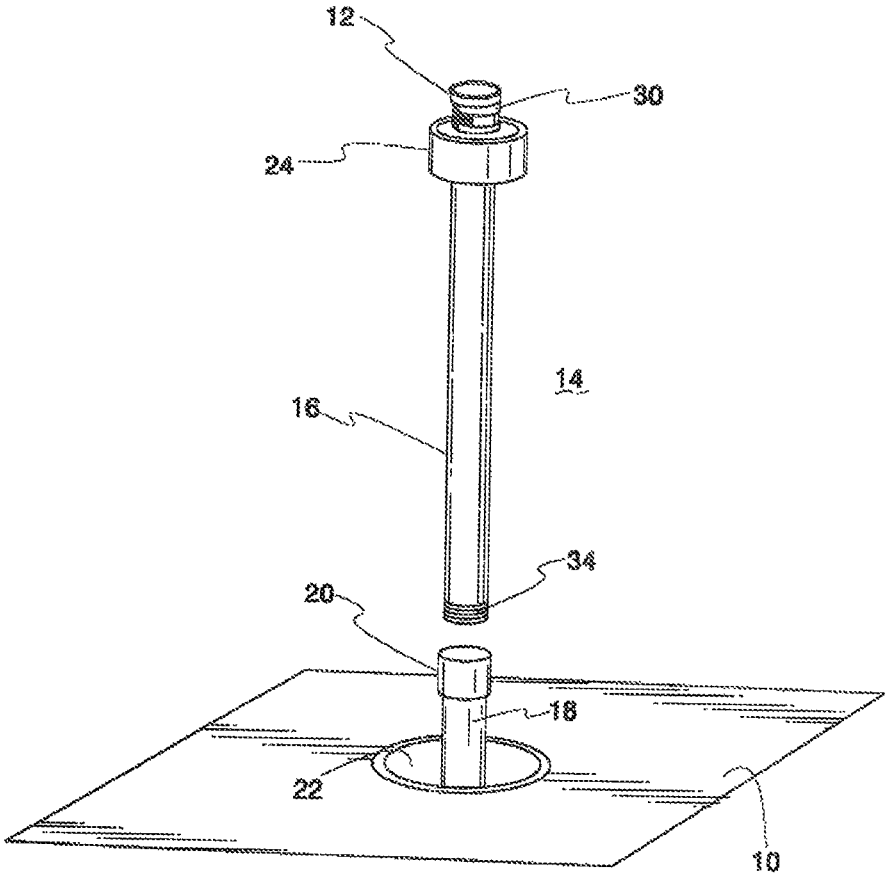
FIG. 1 is a side plan view of a rig floor with a tubular lift ring according to the principles of an embodiment of the present disclosure.

In any event, and turning now to the Figures, and in particular FIG. 1, a side plan view of a rig floor 10 is shown with a tubular lift ring 12 utilized to make up a collared tubular string connection 14. The tubular 16 is positioned above the top 18 of the string such that the bottom pin end threads 34 are coupled via collar 20 before progressing down the borehole 22.

Positioning of successive tubulars is accomplished with the use of the lift ring 12. With the ring 12 coupled to one end of the tubular 16, a slip type elevator 24, for example, compresses the tubular 16 and the tubular is then hoisted by the top drive or the rig draw works. More particularly, the two halves 26 and 28 of the elevator 24 are opened, FIG. 2, and then slidably fastened around the circumference of the tubular. When the elevator traverses towards the top end of the tubular 16, the raised setting plate 30 contacts the lift ring 12, the springs (not shown) inside the elevator compress and bite the teeth/dies 32 on the outside diameter of the tubular 16. Use of a raised setting plate increases the length from the elevator to the teeth/dies that bite the tubular so that it does not damage the area where the threads 34 have been cut into the tubular (the so-called critical area). Once bit, the entire weight of the tubular (and perhaps tubular string) is applied to the dies and tubular and not the lift ring 12. Typically, only approximately 500 lbs of force is needed to compress the springs.

Figure 2:
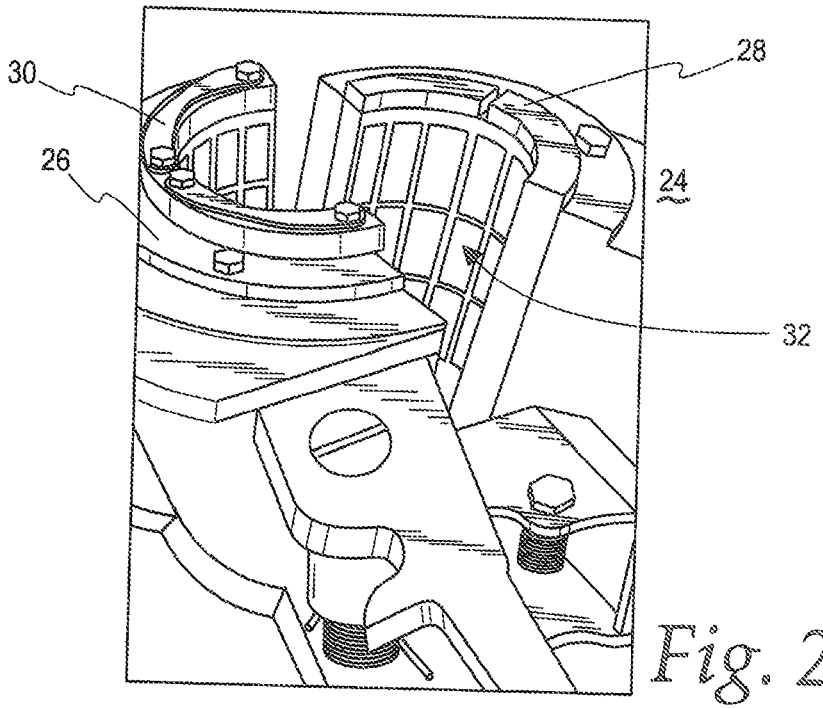
FIG. 2 is a front perspective view of the elevator of FIG. 1 is the open position.
Figure 3:
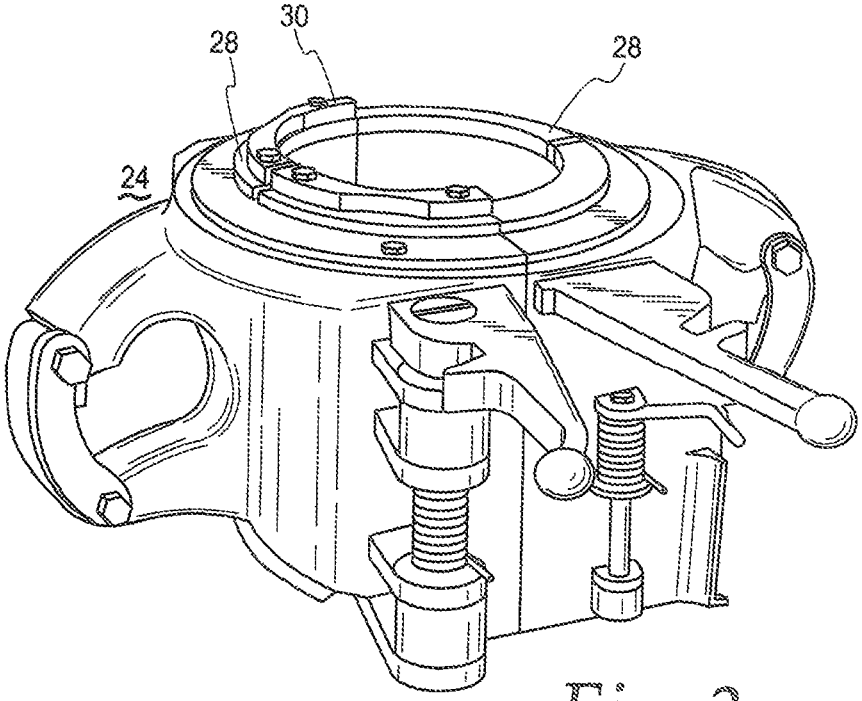
FIG. 3 is a front perspective view of the elevator of FIG. 1 in the closed position.

Essentially, FIG. 1-3 illustrate an exemplary use of the tubular lift ring 12 of the present disclosure. FIGS. 4-8 will now particularly describe the specifics of the tubular lift ring 12 itself. The ring includes an outside diameter 48, an inside diameter 50, and a height 52. The difference between the outside diameter 48 and the inside diameter 50 define the thickness or the upset 38 of the ring. In order to use the subject tubular lift ring, the tubular needs cooperating tubular ring threads. These tubular ring threads are machined over a portion of the tubular pin threads 34 as provided by the manufacturer of the tubular. More specifically, these tubular ring threads are machined through a conventional automated die threading process so as to match the internal threads of the ring 12. As such, the ring 12 may be used with any type of tubular, regardless of its threaded connection.

Figure 4:
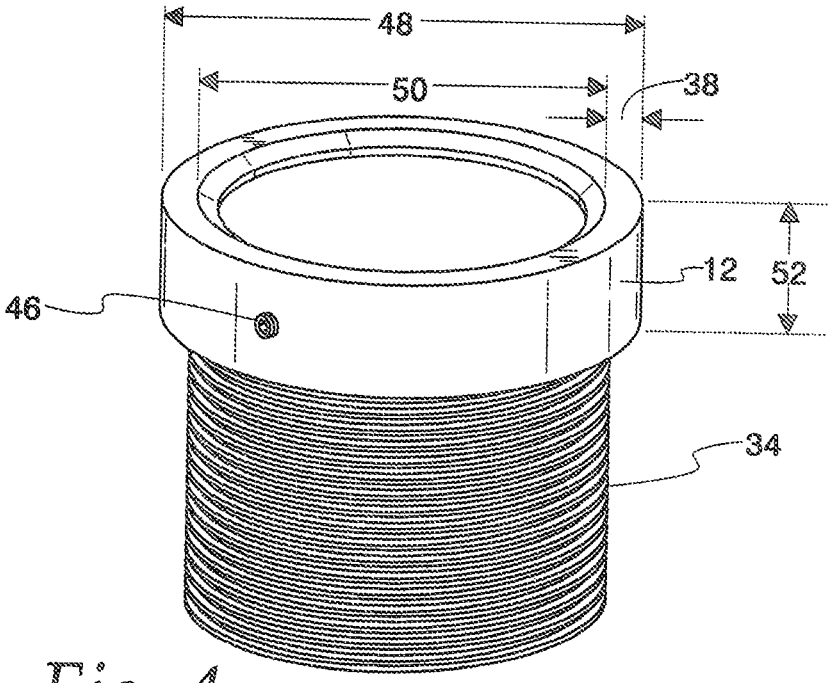
FIG. 4 is an enlarged frontal perspective view of the tubular lift ring according to the principles of an embodiment of the present disclosure.
Figure 5:
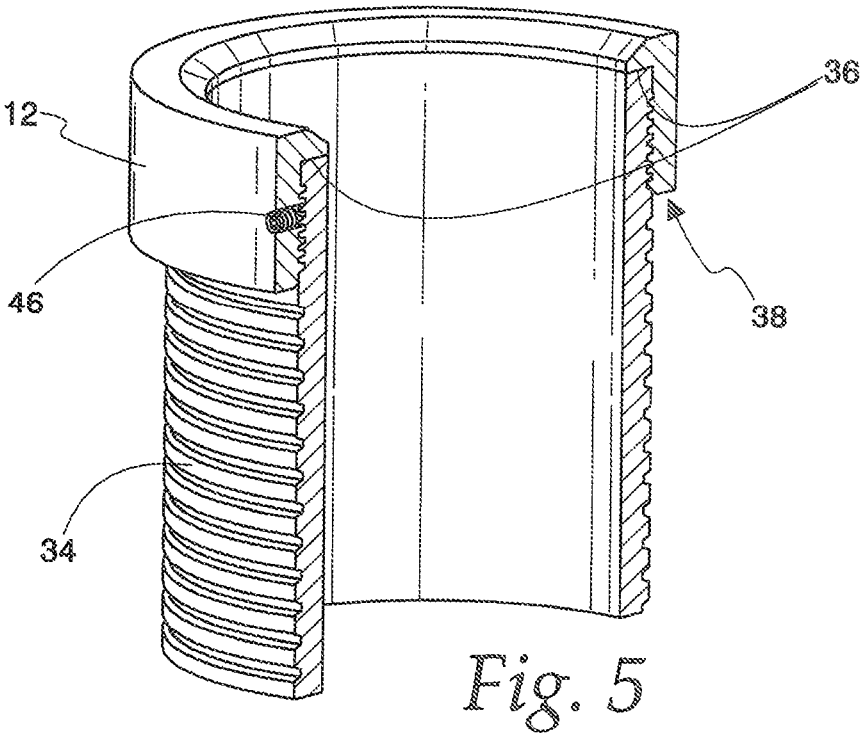
FIG. 5 is a cross-sectional view of the ring and tubular of FIG. 4.

FIG. 4 illustrates the tubular lift ring 12 threaded on the threaded coupling 34 of a joint casing 16. It is threaded on the tubular ring threads until hand tight. FIG. 5 shows the ring 12 threaded and tightened down to a flange 36 of the ring which is generally butted against the end of the tubular. The shoulder or upset 38 of the lift ring 12 is preferably sized to the American Petroleum Institute collar specifications for the particular size of the tubular it is being threaded into. It is this upset that is used as a stoppage point for the lifting elevator to pick up the tubular.

Figure 6:
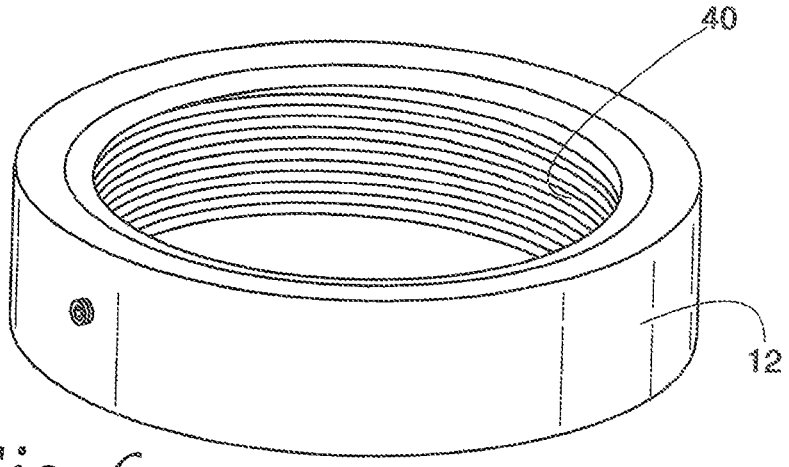
FIG. 6 is a frontal perspective view of the tubular lift ring of FIG. 4.
Figure 7:
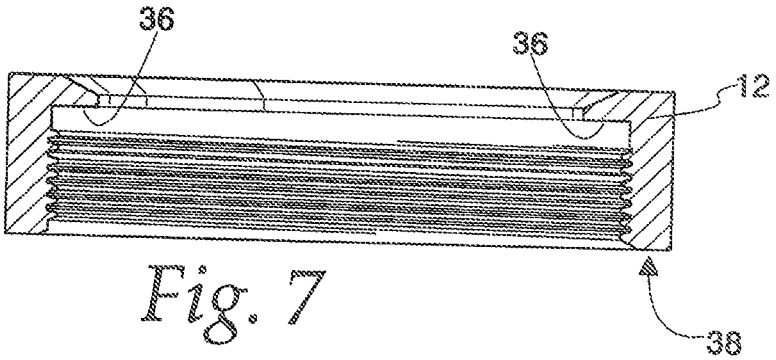
FIG. 7 is a cross-sectional view of the ring of FIG. 6.
Figure 8:
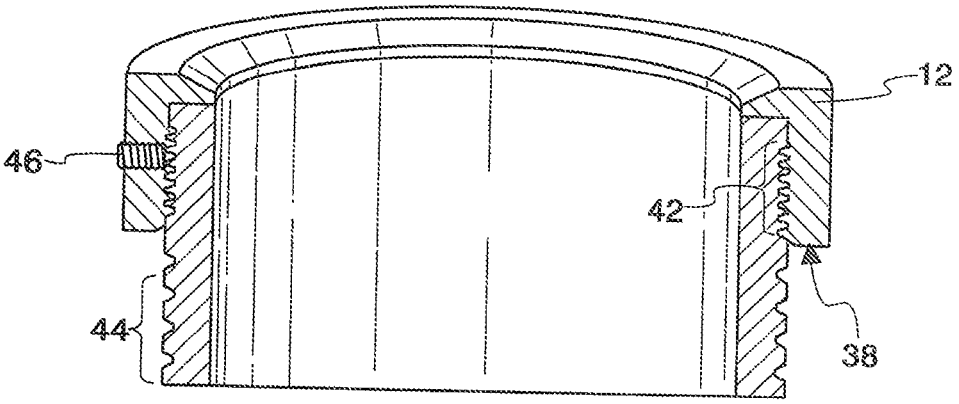
FIG. 8 is another cross-sectional view of the tubular lift ring threaded on a tubular.

The threads 40 on the inside of the ring 12, see FIG. 6, cooperate with the machined tubular ring threading 42 above the tubular threading 44, see FIG. 8. The ring 12 is installed by threading it into the machined tubular ring threading 42 and securing it thereon via a securement bolt or lock screw 46. This threaded connection and lock screw engagement of the tubular gives the lift ring 12 strength.

In make up operation, the elevator 24 encloses the tubular near the end having the subject lift ring 12. Once the raised setting plate 30 of the elevator contacts the upset 38 of the ring, the elevator compresses the outer circumference of the tubular and the rig draw lifts the tubular into place above the previously connected tubular.

As such, the tubular lift ring of the present disclosure provides an advantageous method of making up a tubular string that can be utilized by the entire industry. First, after receiving a number of tubular members having external tubular threading at one end, an end portion of that threading is threaded over to provide external tubular ring threads that enable the tubular lift ring to be threaded on the end of the tubular and then securely locked in place. Once locked, the tubular is slidably engaged with an elevator near the ring end. When the setting of the elevator contacts the offset of the ring, the elevator clamps the outside diameter of the tubular and can then lift the tubular into place above the borehole.

The foregoing detailed description has been given for clearness of understanding only and no unnecessary limitations should be understood therefrom. Accordingly, while one or more particular embodiments of the disclosure have been shown and described, it will be apparent to those skilled in the art that changes and modifications may be made therein without departing from the invention if its broader aspects, and, therefore, the aim in the appended claims is to cover all such changes and modifications as fall within the true spirit and scope of the present disclosure.

What is claimed is:

1. A tubular positioning combination comprising:

a tubular member having external threading on one end;

a first portion of said external threading includes originally-manufactured threads, and a second portion includes machined-over lift ring threads;

a ring having an outside diameter and an inside diameter;

said ring having internal threads for matching said tubular lift ring threads; and said ring having an elevator upset defined by the difference between the diameters.

2. The combination as defined in claim 1 wherein said portion is an end portion of said tubular.

3. The combination as defined in claim 1 whereby a top of said ring includes a flange for fitting against an end of said tubular.

4. The combination as defined in claim 1 including a lock for securing said ring about said tubular.

5. A method for positioning a tubular for making up a tubular string, the method consisting of:

machining a ring thread over a portion of a tubular original manufactured external thread;

threading a lift ring, having internal ring threads and an upset, on said portion of said external threads of said tubular, said internal threads matching said machined over tubular ring threads;

securing said lift ring about said tubular;

engaging said tubular with an elevator having a setting plate whereby when said plate contacts said upset said elevator clamps around said tubular; and lifting said tubular into place.

6. The method as defined by claim 5 whereby said securing includes a screw lock.

* * * * *